US010995504B1

(12) United States Patent
Cook

(10) Patent No.: US 10,995,504 B1
(45) Date of Patent: May 4, 2021

(54) SCAFFOLD STABILIZER

(71) Applicant: David S. Cook, Elgin, IL (US)

(72) Inventor: David S. Cook, Elgin, IL (US)

( * ) Notice: Subject to any disclaimer, the term of this patent is extended or adjusted under 35 U.S.C. 154(b) by 237 days.

(21) Appl. No.: 16/039,862

(22) Filed: Jul. 19, 2018

(51) Int. Cl.
*E04G 7/22* (2006.01)
*E04G 5/16* (2006.01)

(52) U.S. Cl.
CPC ..... *E04G 7/22* (2013.01); *E04G 5/16* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,810,612 | A * | 10/1957 | Weisz | E04G 7/305 403/49 |
| 3,778,498 | A | 12/1973 | Peters et al. | |
| 3,902,817 | A | 9/1975 | Meir | |
| 4,179,090 | A | 12/1979 | Williams et al. | |
| 4,632,222 | A | 12/1986 | Chen | |
| 5,207,527 | A | 5/1993 | Duncan et al. | |
| 6,886,662 | B2 | 5/2005 | Riley | |
| 2005/0199441 | A1 | 9/2005 | Thery | |
| 2007/0045048 | A1 * | 3/2007 | Wyse | E04G 5/10 182/178.1 |
| 2007/0068733 | A1 | 3/2007 | Schlecht | |
| 2008/0128205 | A1 * | 6/2008 | Berlin | E04G 5/16 182/186.7 |
| 2014/0262619 | A1 | 9/2014 | Bains | |
| 2014/0270920 | A1 | 9/2014 | Bacon | |
| 2016/0130824 | A1 | 5/2016 | Chang | |
| 2018/0066440 | A1 | 3/2018 | Ayudarte | |

FOREIGN PATENT DOCUMENTS

| | | | | |
|---|---|---|---|---|
| CN | 105888222 | A | 8/2016 | |
| CN | 106760474 | A | 5/2017 | |
| FR | 2311986 | A1 * | 12/1976 | E04G 7/304 |
| GB | 183985 | | 8/1922 | |
| GB | 879976 | | 2/1958 | |
| GB | 1205338 | | 9/1970 | |
| GB | 1257464 | | 12/1971 | |
| GB | 1318516 | | 5/1973 | |
| GB | 2225827 | A | 6/1990 | |
| GB | 2534092 | A | 7/2016 | |
| GB | 2539375 | A | 12/2016 | |

* cited by examiner

*Primary Examiner* — Kyle Armstrong

(57) ABSTRACT

A stabilizer, especially for a typical interior style baker scaffold, painters scaffold, and the like; used in homes and or buildings largely by various trades reduces the undesired movement of the scaffold. The stabilizer includes a first C-shaped coupler to secure a support bar at a first bar end and a second C-shaped coupler to support a second bar end to the scaffold. This stabilizer will adapt to the typical scaffold frame, and works to eliminate the wobble, wiggle, shake and sway from the scaffold when it is erected as a single piece or as multiple pieces stacked on top of themselves for additional height.

14 Claims, 8 Drawing Sheets

SCAFFOLD STABILIZER

This invention relates to a stabilizer for a scaffold and more particularly to a stabilizer for a scaffold used indoors, which reduces the flexibility of scaffold and increases the stability thereof. This stabilizer can eliminate instability from the scaffold when it is erected as a single piece or as multiple pieces stacked on top of each other.

BACKGROUND OF THE INVENTION

In the process of decorating or otherwise treating the inside of a building, it is necessary to reach above the normal reach of a person. This applies to painting, hanging wallpaper, or otherwise decorating a particular area. When reaching above the normal reach of a person, a ladder or a scaffold is a common way to achieve that goal.

Use of a ladder requires too much movement. Use of a scaffold minimizes movement, but causes a stability problem. Steps to maximize the stability of the scaffold can interfere with the ease of assembly and other uses of the scaffold.

An interior scaffold such as baker's scaffold or painter's scaffold is needed to work on home building, repair, or remodel. However each of these products lack stability. This type of scaffold is used when trades need a platform to work on for home building, repair, or remodel. It is sold or rented by hardware and home improvement stores, paint supply stores, as well as directly from scaffold manufactures and tool rental stores.

The stability issues affecting a scaffold are well-known. For example, the typical interior style baker scaffold and painters scaffold designs are present across the entirety of all currently designed alike products making stability an issue for anyone using these types of scaffolds. The scaffold has a wobble, wiggle, shake or sway when it is erected as a single piece or as multiple pieces stacked on top of themselves for additional height.

It becomes clear that stabilizing the scaffold without substantially increasing the effort to assemble or disassemble the scaffold provides a great advantage to anyone desiring to use the scaffold. This is especially true for a scaffold, which is used for interior decoration of a building, whether that building is commercial or residential.

SUMMARY OF THE INVENTION

Among the many objectives of the present invention is the provision of a suitable stabilizer for a scaffold.

Another objective of the present invention is the provision of a clip assembly to stabilize the movement of a scaffold.

Yet another objective of the present invention is the provision of a suitable stabilizer for a scaffold used indoors.

Still another objective of the present invention is the provision of a clip assembly to stabilize the movement of a scaffold used indoors.

A further objective of the present invention is the provision of a clip assembly to at least reduce the wobble of a scaffold.

A still further objective of the present invention is the provision of a suitable stabilizer to at least reduce the wiggle of a scaffold.

Yet a further objective of the present invention is the provision of a clip assembly to at least reduce the shake of a scaffold.

Also an objective of the present invention is the provision of a suitable stabilizer to at least reduce the sway of a scaffold.

Another objective of the present invention is the provision of a stabilizer, which is easily attached to a scaffold.

Yet another objective of the present invention is the provision of a stabilizer, which is easily removed from a scaffold.

Still another objective of the present invention is the provision of a stabilizer, which improves the safety of a scaffold.

These and other objectives of the invention (which other objectives become clear by consideration of the specification, claims and drawings as a whole) are met by providing a scaffold stabilizer, which reduces instability of a scaffold, especially a scaffold used inside.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
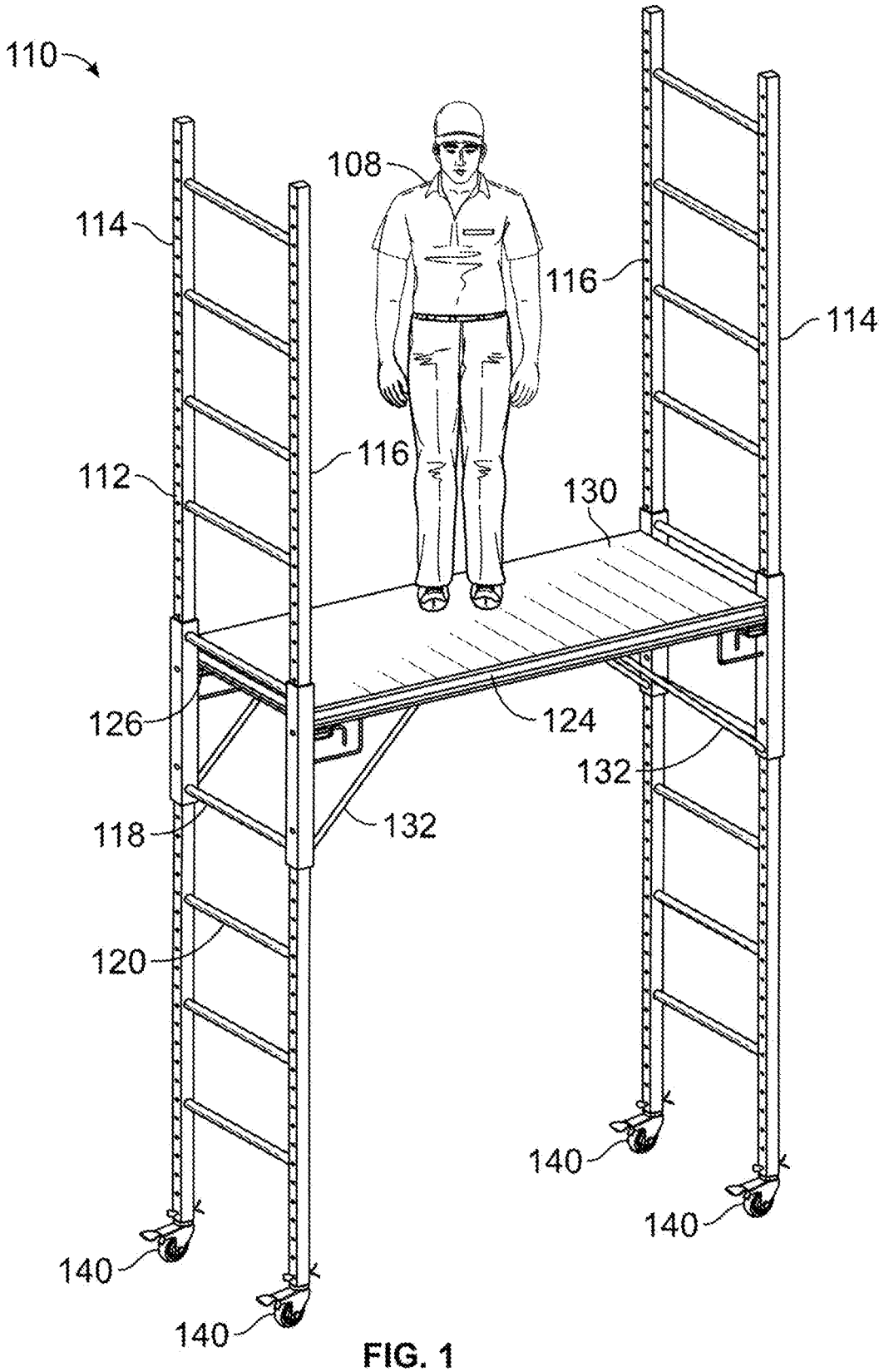
FIG. 1 (Prior Art)
FIG. 1 depicts a front perspective view of a scaffold 110 commonly in use for the prior art.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

For purposes of convenience and clarity only, directional terms such as proximal, distal, ventral, and dorsal, may be used with respect to the drawings. The terms "proximal" and "distal" refers to the anatomical definition indicating the regions nearer and further, respectively, to the center of the body or the point of attachment, specifically referring to the length of the handle assembly. The terms "ventral" and "dorsal" refers to the anatomical definition indicating the underside and upper side of the invention.

To a standard scaffold may be added a stabilizer. The stabilizer has a support bar connected to opposing upright posts of the scaffold by a C-shaped coupler suitably securable to both the upright post and the support bar. With at least one stabilizer added to opposing upright posts of the scaffold, the scaffold becomes more stable. This invention works to eliminate the instability from the scaffold when erected as a single piece or as multiple pieces stacked on top of each other.

Thus, the scaffold becomes much safer to use. Swaying and rocking of the scaffold is greatly reduced. It also is much easier and safer to climb up and down the scaffold.

This invention is especially useful in providing improved stability for a typical interior style baker scaffold, painters scaffold, and the like. The stabilizer is especially effective on a scaffold typically used in homes or buildings and utilized largely by various trades. This stabilizer will adapt to the typical scaffold frame, mentioned above, and works to at least substantially reduce, if not eliminate the wobble, wiggle, shake and sway from the scaffold when it is erected as a single platform support or as multiple platform support in a stacked arrangement for additional height.

The stabilizer has two initial bars and three engineered C-shaped couplers. These couplers are secured to the scaffold frame by pins. A pin rod (aka the first coupler pin and/or larger pin) slides through one end of the coupler, then the frame's leg, and finally out through the other end of the coupler. This first coupler pin is then secured by a smaller second coupler pin, sometimes referred to as a cotter pin or R-clip. Located on the remaining side of the C-shaped coupler is a stationary bolt or pin, which extends from the surface of the coupler, called a mounting rod. This mounting rod allows for one end of the stabilizer bar to securely slide over the stationary bolt or pin and through the pre-drilled concentric apertures in the end of the stabilizer bar. These bars again will be secured by a first mounting pin that is optionally secured by a smaller, second mounting pin in some embodiments.

The at least two bars and the at least three couplers stabilize the scaffold. While it is not desired to bound by any particular theory, it is believed that triangulation created by the bars and couplers with the scaffold greatly reduce the sway and other scaffold problems.

Two of the couplers are secured to the lower portion of the scaffold legs while the third is attached towards the top of the opposite leg. The first stabilizer bar connects the legs at the bottom using two bottom couplers together creating the lower horizontal portion of the stabilizer. The second stabilizer bar connects from the bottom of the frame's leg that only has one coupler and reaches diagonally across to the opposite leg hosting the upper coupler. After the second stabilizer bar is attached using the C-shaped coupler and cotter pin, this combination completes the stabilizer and effectively at least reduces the sway or movement which is normally associated with these indoor scaffolds.

Referring now to FIG. 1 as a representation of the prior art, a person 108 stands on scaffold 110 of the prior art. Scaffold 110 has at least two assembly sections 112. Each assembly section 112 has a first vertical bar 114 and a second vertical bar 116 connected by at least a first horizontal bar 118 and a second horizontal bar 120, which are substantially and mutually parallel as the first vertical bar 114 is substantially parallel to the second vertical bar 116. First vertical bar 114 and a second vertical bar 116 combine with as many of the first horizontal bar 118 and the second horizontal bar 120 as desired to form a ladder-like appearance.

The first vertical bar 114 and the second vertical bar 116 usually have a square cross-section and a series of adjustment apertures 122 in each side thereof to permit securing of the first platform support bar 124 and second platform support bar 126 therebetween in the parallel fashion to receive a platform 130 on which a person 108 may stand. Likewise a first platform support bar 124 and second platform support bar 126 are substantially and mutually parallel.

Also each of the first vertical bar 114 and the second vertical bar 116 usually have a usually a lockable castor wheel 140 secured to an end thereof, in contact with a floor, substantially level ground or other substantially level surface. The lockable castor wheel 140 facilitates moving of the scaffold 110 short distances.

The first platform support bar 124 and second platform support bar 126 secure a first assembly section 112 to a second assembly section 112 thereby forming a base on which a platform 130 may be placed. Braces 132 connect first platform support bar 124 and second platform support bar 126 to the respective first assembly section 112 to a second assembly section 112. The adjustment apertures 122 (FIG. 3*a* and FIG. 3*b*) permit adjusting the height of the platform 130 and the braces 132, so that a person 108 may stand thereon and do the necessary procedure such as painting, wallpapering or the like.

Figure 2:
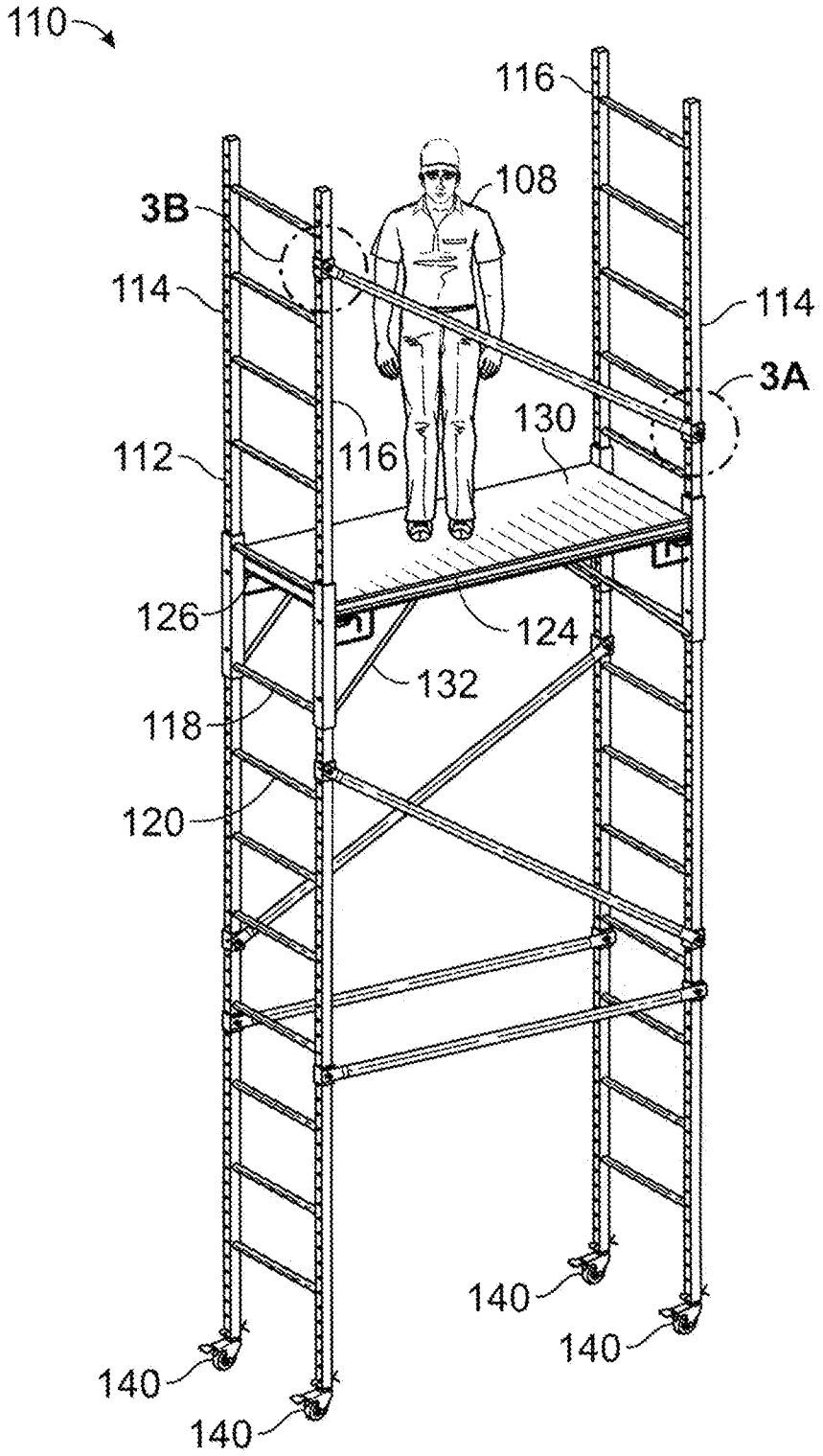
FIG. 2 depicts a front perspective view of a scaffold 110 using stabilizer 100 of this invention.
Figure 3A:
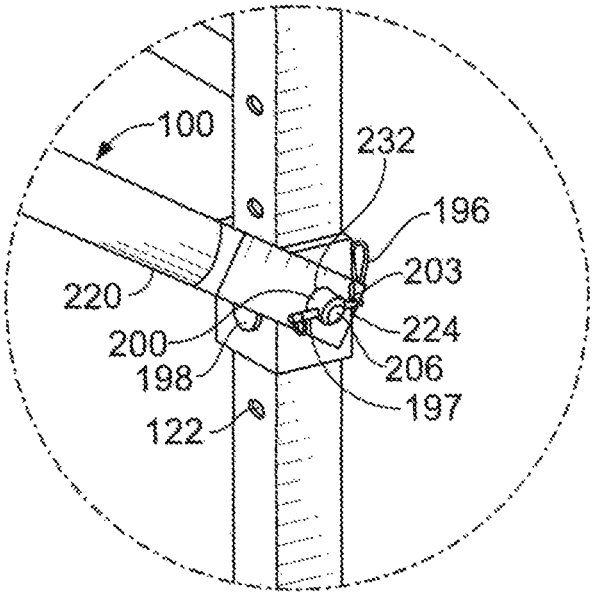
FIG. 3*a* depicts a perspective view of a C-shaped coupler 180 and first bar end 222 for stabilizer 100 of this invention in a close-up view when mounted on a first vertical bar 114 of a scaffold 110.
Figure 3B:
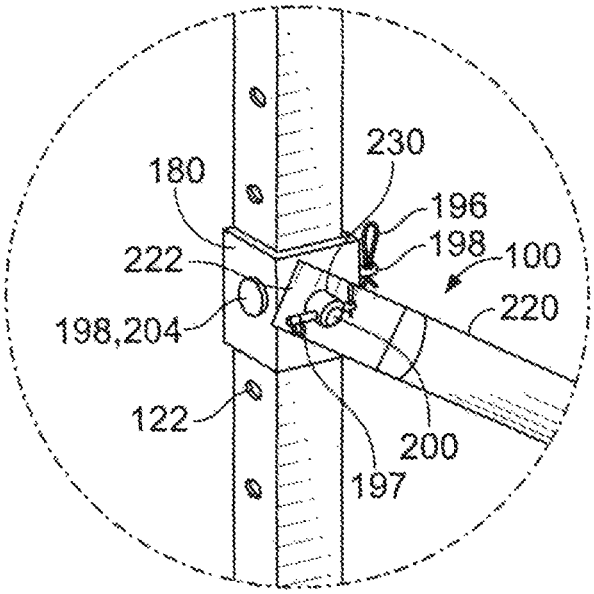
FIG. 3*b* depicts a perspective view of a C-shaped coupler 180 and second bar end 224 for stabilizer 100 of this invention in a close-up view when mounted on a second vertical bar 116 of a scaffold 110.
Figure 4:
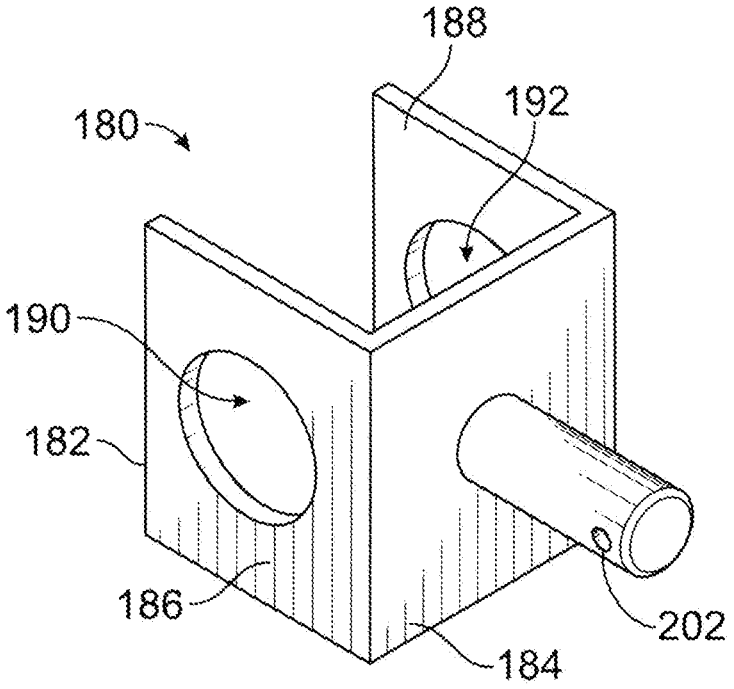
FIG. 4 depicts a front, perspective view of a C-shaped coupler 180 for stabilizer 100 of this invention.
Figure 5:
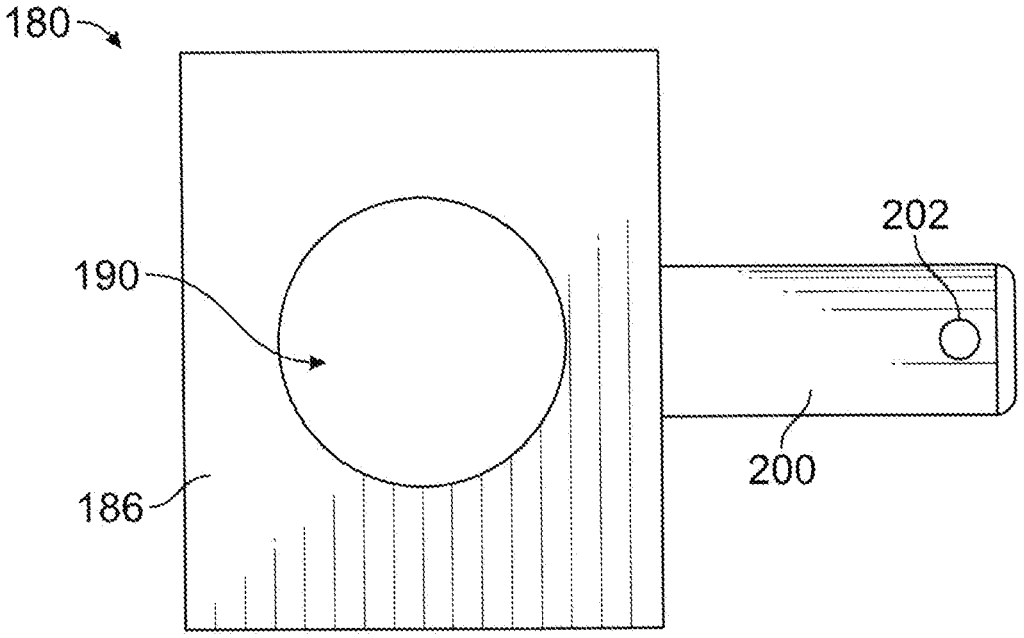
FIG. 5 depicts a side view of a C-shaped coupler 180 for stabilizer 100 of this invention.
Figure 6:
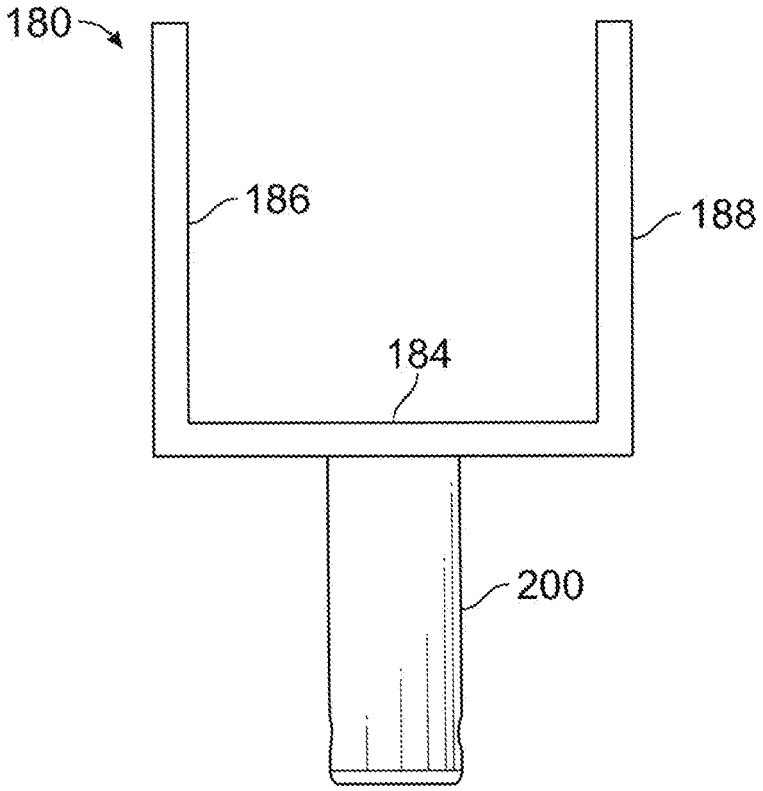
FIG. 6 depicts a top, plan view of a C-shaped coupler 180 for stabilizer 100 of this invention.
Figure 7:
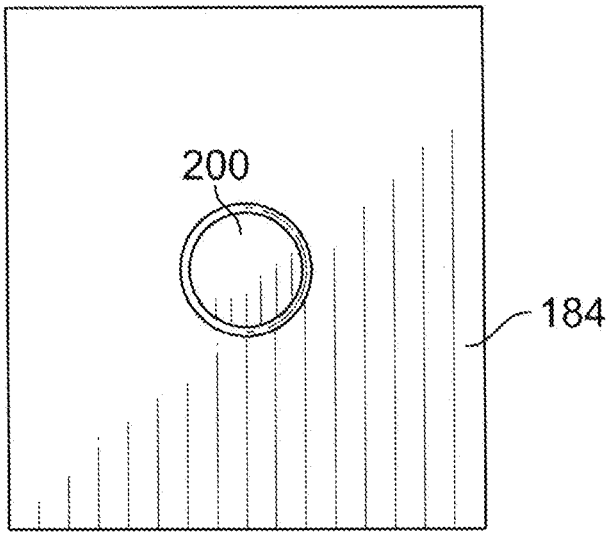
FIG. 7 depicts a front, plan view of a C-shaped coupler 180 for stabilizer 100 of this invention.
Figure 8:
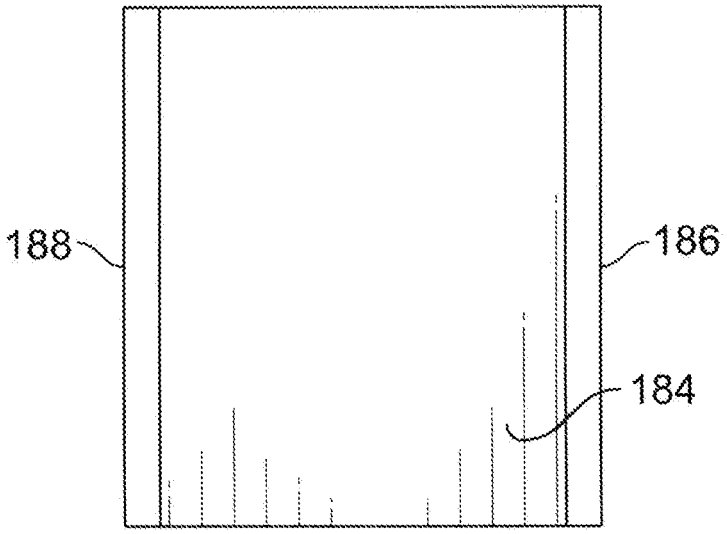
FIG. 8 depicts a rear, plan view of a C-shaped coupler 180 for stabilizer 100 of this invention.

Referring now to FIG. 2, FIG. 3*a* and FIG. 3*b*; the use of stabilizer 100 with scaffold 110 becomes clear. Stabilizer 100 includes a C-shaped coupler 180 and a support bar 220. Support bar 220 has a first bar end 222 and a second bar end 224. First bar end 222 includes first bar end concentric apertures 230, while second bar end 224 includes second bar end concentric apertures 232. First bar end concentric apertures 230 receive mounting rod 200, while second bar end concentric apertures 232 receive a second mounting rod 200 of second C-shaped coupler 180.

For stabilizer 100 of this invention when mounted on a first vertical bar 114 and the second vertical bar 116 of a scaffold 110, stability of the scaffold 110 is achieved. Support bar 220 and couplers 180 combine with cotter pins 196, first mounting pins 197, and pin rods 198 of the stabilizer 100 and work with adjustment apertures 122 to give additional stability to the scaffold 120.

Support bar 220 is of sufficient length to connect the first assembly section 112 to the second assembly section 112 at an angle thereto or perpendicular thereto as desired. So first bar end 222 and second bar end 224 are connected to separate C-shaped couplers 180, mounted on separate vertical bars 114 or 116 of a separate assembly section 112. Thus, the sway and other undesired movement of the scaffold 110 is reduced by stabilizer 100, making the scaffold 110 much safer to use. It is also easy to attach or remove the stabilizer 100 from the scaffold 110.

Adding FIG. 4, FIG. 5, FIG. 6, FIG. 7, and FIG. 8 to the consideration with FIG. 2, FIG. 3*a* and FIG. 3*b*; the C-shaped coupler 180 includes a C-shaped member 182, having a flat base 184, and a first arm 186 and a second arm 188 extending from opposite ends of the flat base 184 in a fashion substantially parallel to each other. First arm 186 includes a first arm aperture 190. Second arm 188 includes a second arm aperture 192. First arm aperture 190 and second arm aperture 192 are substantially concentric.

First arm aperture 190 and second arm aperture 192 align with adjustment apertures 122 to receive a pin rod 198 to complete stabilizer 100. So one version of stabilizer 100 may include two C-shaped couplers 180, a support bar 220, the pin rod 198 and appropriate fasteners.

Extending from the flat base 184 and oppositely disposed from first arm 186 and second arm 188 is a mounting rod 200. Within a mounting rod 200 is a pin receiving aperture 202 for the purpose of securing the C-shaped coupler 180 to support bar 220 as desired.

Figure 9:
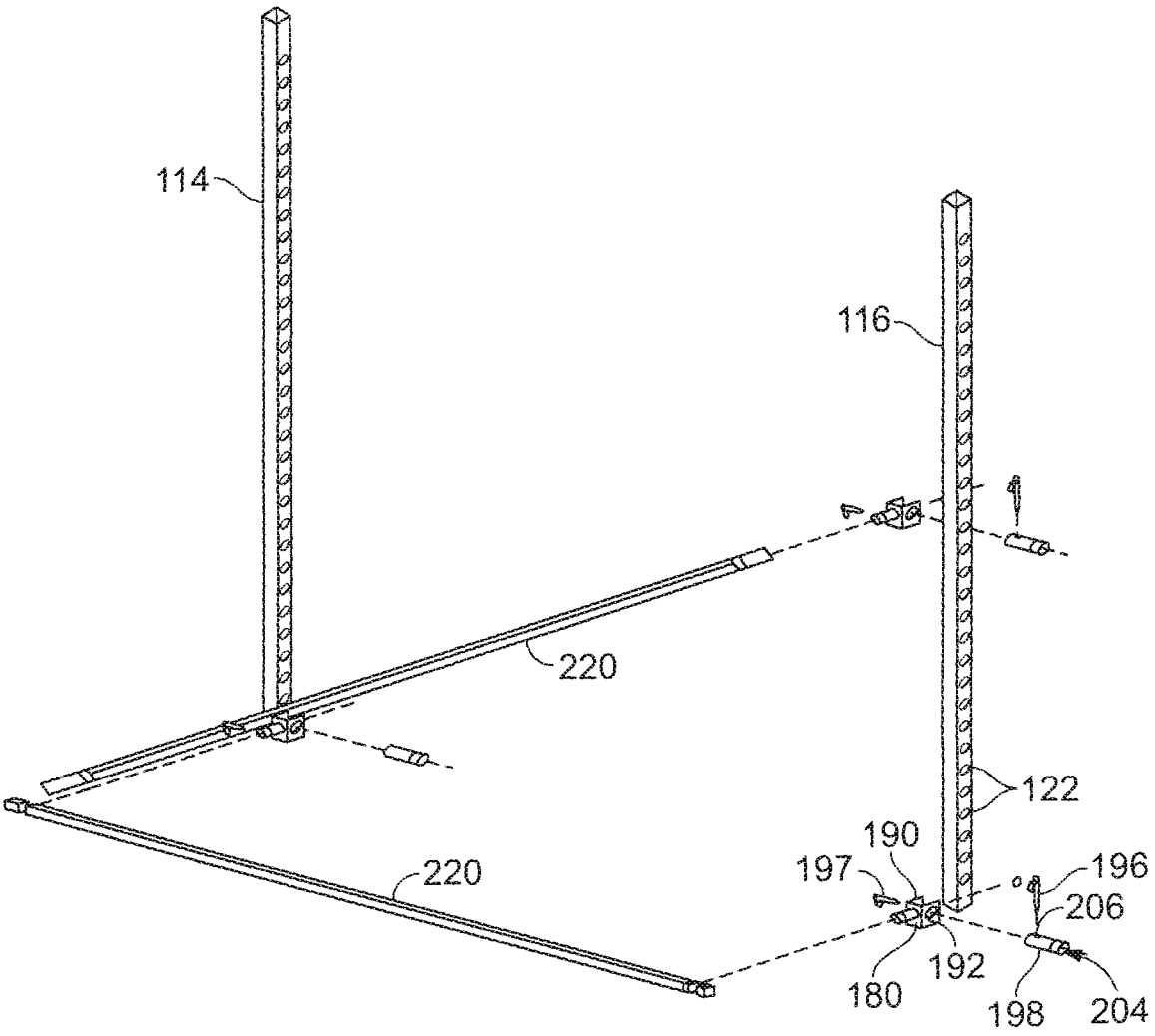
FIG. 9 depicts a perspective, exploded view of stabilizer 100 mounted on a first vertical bar 114 and a second vertical bar 116 of a scaffold 110.

Adding FIG. 9 to the consideration, first vertical bar 114 and second vertical bar 116 are connected by a horizontal support bar 220 and an angled support bar 220. The horizontal support bar 220 is shorter than angled support bar 220. C-shaped coupler 180 connects first vertical bar 114 and second vertical bar 116 to opposing ends of the support bars 220. First arm aperture 190 and second arm aperture 192 align with adjustment apertures 122 of first vertical bar 114 and second vertical bar 116 so that pin rod 198 passes through all of the aligned apertures. Pin rod head 204 on one end of pin rod 198 holds pin rod 198 in place in combination with pin rod aperture 206 in pin rod 198, oppositely disposed from pin rod head 204. Pin rod aperture 206 receives a cotter pin 196 thereby holding coupler 180 in position to secure support bar 220 either first vertical bar 114 or second vertical bar 116.

As a holding coupler 180 is secured, support bar 220 receives mounting rod 200 through first bar end 222 and second bar end 224 at first bar end concentric apertures 230 and second bar end concentric apertures 232 respectively. Pin receiving aperture 202 receives a first mounting pin 197 and releasably secures first bar end 222 and second bar end 224 on their respective mounting rods 200.

Figure 10:
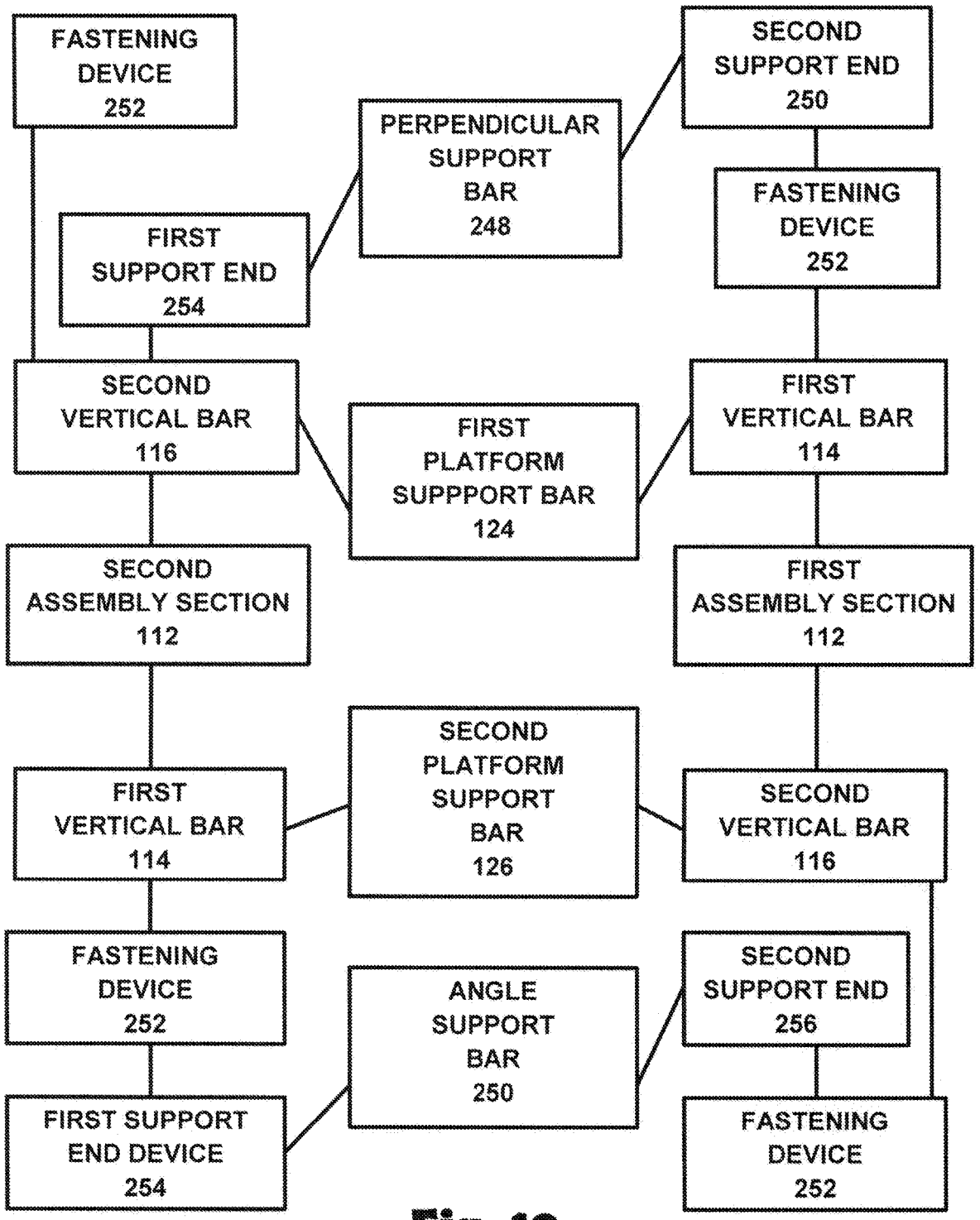
FIG. 10 depicts a block diagram of a supported stabilizer 300 for a scaffold 110.

Referring now to FIG. 10, scaffold 110 includes an assembly section 112 with a first vertical bar 114 and a second vertical bar 116, each having adjustment apertures 122 therein. A first platform support bar 124 and a second platform support bar 126 join at least one first assembly section 112 to at least one second assembly section 112. This structure forms a base to support a platform 130.

The scaffold 110 of FIG. 10 is stabilized by at least one perpendicular support bar 248 and one angle support bar 250 connecting opposite first vertical bar 114 and second vertical bar 116. Perpendicular support bar 248 connects to opposite first vertical bar 114 and second vertical bar 116 and is substantially perpendicular to both first vertical bar 114 and second vertical bar 116. Angle support bar 250 connects to opposite first vertical bar 114 and second vertical bar 116 and is not perpendicular to either first vertical bar 114 or second vertical bar 116.

Both perpendicular support bar 248 and one angle support bar 250 have a fastening device 252 cooperating with each of first support end 254 and oppositely disposed second support end 256 to secure the same to opposing vertical bars 114 or 116. Perpendicular support bar 248 is substantially perpendicular to the opposing vertical bars 114 or 116. Angle support bar 250 an angle with the opposing vertical bars 114 and 116. Such triangulation provides for stability.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A scaffold stabilizer for supporting an interior scaffold apparatus, comprising:
- an interior scaffold apparatus with a plurality of anterior vertical legs and a plurality of dorsal vertical legs;
- the plurality of anterior vertical legs and the plurality of dorsal vertical legs which have a plurality of frame apertures;
- the plurality of anterior vertical legs having a left anterior vertical leg and a right anterior vertical leg;
- the interior scaffold apparatus having a plurality of platforms;
- the plurality of platforms being a middle platform and a top platform;
- the dorsal vertical legs having a left dorsal vertical leg and a right dorsal vertical leg;
- a plurality of pin fasteners;
- a plurality of C-shaped couplers secured to the plurality of anterior vertical legs and the plurality of dorsal vertical legs by a pin fastener;
- the plurality of C-shaped couplers secured to the plurality of anterior vertical legs being of differing elevations;
- the plurality of C-shaped couplers secured to the plurality of dorsal vertical legs being of differing elevations;
- a plurality of stabilizer bars being a plurality of anterior stabilizer bars and a plurality of dorsal stabilizer bars;
- the plurality of anterior stabilizer bars secured to the plurality of C-shaped couplers secured to the plurality of anterior vertical legs;
- the plurality of dorsal stabilizer bars secured to the plurality of C-shaped couplers secured to the plurality of dorsal vertical legs;
- a plurality of C-shaped couplers with a C-shaped member;
- a C-shaped member having a flat base, a first arm, and a second arm;
- the first arm having a first arm aperture;
- the second arm having a second arm aperture; and
- the first arm aperture and the second arm apertures being at the opposite ends of the flat base.

2. A stabilized scaffold comprising:
- a scaffold having at least one first assembly section cooperating with at least one second assembly section with a stabilizer supporting the scaffold;
- a first platform support bar a second platform support bar connecting the at least one first assembly section to the at least one second assembly section;
- the at least one first assembly section being substantially symmetrical to the at least one second assembly section;
- the at least one first assembly section and to the at least one second assembly section each having a first vertical bar and a second vertical bar;
- the first vertical bar and the second vertical bar each having adjustment apertures therein;
- the first platform support bar and the second platform support bar join the at least one first assembly section to the at least one second assembly section to support a platform by connecting to the adjustment apertures;

at least one substantially perpendicular support bar connecting an opposite first vertical bar and an opposite second vertical bar;

at least one angle support bar connecting an opposite first vertical bar and an opposite second vertical bar;

the at least one substantially perpendicular support bar being substantially perpendicular to both the first opposite first vertical bar and the second opposite vertical bar;

the at least one angle support bar connecting the opposite first vertical bar and the opposite second vertical bar at an acute angle thereto;

each of the at least one perpendicular support bar and the at least one angle support bar having a fastening device;

the fastening device cooperating with each of a first support end and a second support end of the at least one perpendicular support bar and the at least one angle support bar to secure the same to the opposite first vertical bar and the opposite second vertical bar;

the fastening device, the at least one perpendicular support bar and the at least one angle support bar thus forming the stabilized scaffold from the scaffold;

a stabilizer being added to form the stabilized scaffold;

the stabilizer including the at least one perpendicular support bar and the at least one angle support bar;

the stabilizer further including a C-shaped coupler secured at each end of the at least one perpendicular support bar and the at least one angle support bar to form the stabilized scaffold;

the at least one perpendicular support bar being connected at each end thereof and substantially perpendicularly to the opposite first vertical bar and the opposite second vertical bar by the C-shaped coupler;

the coupler being secured to the first vertical support bar or the second vertical support bar by a first coupler pin; and the first coupler pin first slides through a first end of the C-shaped coupler, then through the first vertical support bar or the second vertical support bar and finally out through a second end of the C-shaped coupler.

3. The stabilized scaffold of claim 2 further comprising:

the C-shaped coupler having a first end aperture in the first end;

the C-shaped coupler having a second end aperture in the second end;

the first end aperture and the second end aperture being concentric;

the first end aperture and the second end aperture with the opposite first vertical bar or the opposite second vertical bar therebetween receiving the first coupler pin;

the first coupler pin being secured in the first end aperture and the second end aperture by a second coupler pin; and the C-shaped coupler having a flat base.

4. A The stabilized scaffold comprising:

a scaffold having at least one first assembly section cooperating with at least one second assembly section with a stabilizer supporting the scaffold;

a first platform support bar a second platform support bar connecting the at least one first assembly section to the at least one second assembly section;

the at least one first assembly section being substantially symmetrical to the at least one second assembly section;

the at least one first assembly section and to the at least one second assembly section each having a first vertical bar and a second vertical bar;

the first vertical bar and the second vertical bar each having adjustment apertures therein;

the first platform support bar and the second platform support bar loin the at least one first assembly section to the at least one second assembly section to support a platform by connecting to the adjustment apertures;

at least one substantially perpendicular support bar connecting an opposite first vertical bar and an opposite second vertical bar;

at least one angle support bar connecting an opposite first vertical bar and an opposite second vertical bar;

a stabilizer being added to form the stabilized scaffold;

the stabilizer including at least three C-shaped couplers and at least one substantially perpendicular support bar and at least one angle support bar;

the at least one substantially perpendicular support bar having a first perpendicular bar end and a second, oppositely disposed, perpendicular bar end;

the at least one substantially perpendicular support bar being substantially perpendicular to the opposite first vertical bar and the opposite second vertical bar;

the at least one angle support bar being at an acute angle relative to the opposite first vertical bar and the opposite second vertical bar;

one of the at least three C-shaped couplers being secured to the opposite first vertical bar and the first perpendicular bar end;

one of the at least three C-shaped couplers being secured to the opposite second vertical bar and the second perpendicular bar end;

one of the at least three C-shaped couplers being secured to a first end of the angle support bar;

the C-shaped coupler including a C-shaped member;

the C-shaped member having a flat base, and a first arm parallel to a second arm extending from opposite ends of the flat base;

the first arm including a first arm aperture;

the second arm including a second arm aperture;

the first arm aperture being substantially concentric to the second arm aperture;

a mounting rod extending from the flat base;

the mounting rod being oppositely disposed from the first arm and the second arm;

the opposite first vertical bar and the opposite second vertical bar including a series of paired adjustment apertures;

a pin rod to hold C-shaped coupler in position; and each member of the paired adjustment apertures being alignable with the first arm aperture and second arm aperture to form aligned apertures in order to receive the mounting pin.

5. The stabilized scaffold of claim 4 further comprising:

the mounting rod including a pin receiving aperture;

the first perpendicular bar end and the second perpendicular bar end each having a perpendicular bar aperture the perpendicular bar aperture receiving a separate one of the mounting rod;

the at least one angle support bar having a first angle bar end oppositely disposed from a second angle bar end;

the first angle bar end and the second angle bar end each having an angle bar aperture;

the first angle bar aperture receiving a separate one of the mounting rod;

the at least one angle support bar being at an acute angle relative to the opposite first vertical bar and the opposite second vertical bar; and a pin rod in pin receiving aperture securing the C-shaped coupler to the support bar as desired.

6. The stabilized scaffold of claim 5 further comprising:

the horizontal support bar being shorter than the angled support bar;

the support bars first arm aperture and the second arm aperture align with a pair of adjustment apertures of the first vertical bar or the second vertical bar so that the pin rod passes through all of the aligned apertures;

a rod head on one end of the pin rod holds the pin rod in place in combination with a rod aperture in pin rod, oppositely disposed from rod head;

the rod aperture receiving a pin rod, thereby holding coupler in position to secure the support bar to either the first vertical bar or the second vertical bar.

7. In a scaffold for use in a building, the improvement comprising:

a stabilizer supporting the scaffold;

the scaffold having at least one first assembly section cooperating with at least one second assembly section with a stabilizer supporting the scaffold;

a first platform support bar a second platform support bar connecting the at least one first assembly section to the at least one second assembly section;

the at least one first assembly section being substantially symmetrical to the at least one second assembly section;

the at least one first assembly section and to the at least one second assembly section each having a first vertical bar and a second vertical bar;

the first vertical bar and the second vertical bar each having adjustment apertures therein;

the first platform support bar and the second platform support bar join the at least one first assembly section to the at least one second assembly section to support a platform by connecting to the adjustment apertures; and at least one substantially perpendicular support bar connecting an opposite first vertical bar and an opposite second vertical bar.

8. The scaffold of claim 7 further comprising:

at least one angle support bar connecting an opposite first vertical bar and an opposite second vertical bar;

the at least one substantially perpendicular support bar being substantially perpendicular to both the first opposite first vertical bar and the second opposite vertical bar;

the at least one angle support bar connecting the opposite first vertical bar and the opposite second vertical bar at an acute angle thereto;

each of the at least one perpendicular support bar and the at least one angle support bar having a fastening device;

the fastening device cooperating with each of a first support end and a second support end of the at least one perpendicular support bar and the at least one angle support bar to secure the same to the opposite first vertical bar and the opposite second vertical bar; and the fastening device, the at least one perpendicular support bar and the at least one angle support bar thus forming the stabilized scaffold from the scaffold.

9. The scaffold of claim 8 further comprising:

the stabilizer being added to form the stabilized scaffold;

the stabilizer including the at least one perpendicular support bar and the at least one angle support bar;

the stabilizer further including a C-shaped coupler secured at each end of the at least one perpendicular support bar and the at least one angle support bar to form the stabilized scaffold;

the at least one perpendicular support bar being connected at each end thereof and substantially perpendicularly to the opposite first vertical bar and the opposite second vertical bar by the C-shaped coupler;

the coupler being secured to the first vertical support bar or the second vertical support bar by a first coupler pin; and the first coupler pin first slides through a first end of the C-shaped coupler, then through the first vertical support bar or the second vertical support bar and finally out through a second end of the C-shaped coupler.

10. The scaffold of claim 9 further comprising:

the C-shaped coupler having a first end aperture in the first end;

the C-shaped coupler having a second end aperture in the second end;

the first end aperture and the second end aperture being concentric;

the first end aperture and the second end aperture with the opposite first vertical bar or the opposite second vertical bar therebetween receiving the first coupler pin;

the first coupler pin being secured in the first end aperture and the second end aperture by a second coupler pin; and the C-shaped coupler having a flat base.

11. The scaffold of claim 7 further comprising:

a stabilizer being added to form the stabilized scaffold;

the stabilizer including at least three C-shaped couplers and at least one substantially perpendicular support bar and at least one angle support bar;

the at least one substantially perpendicular support bar having a first perpendicular bar end and a second, oppositely disposed, perpendicular bar end;

the at least one substantially perpendicular support bar being substantially perpendicular to the opposite first vertical bar and the opposite second vertical bar;

the at least one angle support bar being at an acute angle relative to the opposite first vertical bar and the opposite second vertical bar;

one of the at least three C-shaped couplers being secured to the opposite first vertical bar and the first perpendicular bar end;

one of the at least three C-shaped couplers being secured to the opposite second vertical bar and the second perpendicular bar end; and one of the at least three C-shaped couplers being secured to a first end of the angle support bar.

12. The scaffold of claim 11 further comprising:

the C-shaped coupler including a C-shaped member;

the C-shaped member having a flat base, and a first arm parallel to a second arm extending from opposite ends of the flat base;

the first arm including a first arm aperture;

the second arm including a second arm aperture;

the first arm aperture being substantially concentric to the second arm aperture;

a mounting rod extending from the flat base;

the mounting rod being oppositely disposed from the first arm and the second arm;

the opposite first vertical bar and the opposite second vertical bar including a series of paired adjustment apertures;

a pin rod to hold C-shaped coupler in position; and each member of the paired adjustment apertures being alignable with the first arm aperture and second arm aperture to form aligned apertures in order to receive the mounting pin.

13. The scaffold of claim 12 further comprising:

the mounting rod including a pin receiving aperture;

the first perpendicular bar end and the second perpendicular bar end each having a perpendicular bar aperture;

the perpendicular bar aperture receiving a separate one of the mounting rod;

the at least one angle support bar having a first angle bar end oppositely disposed from a second angle bar end;

the first angle bar end and the second angle bar end each having an angle bar aperture;

the first angle bar aperture receiving a separate one of the mounting rod;

the at least one angle support bar being at an acute angle relative to the opposite first vertical bar and the opposite second vertical bar; and a pin rod in pin receiving aperture securing the C-shaped coupler to the support bar as desired.

14. The scaffold of claim 13 further comprising:

the horizontal support bar being shorter than the angled support bar;

the support bars first arm aperture and the second arm aperture align with a pair of adjustment apertures of the first vertical bar or the second vertical bar so that the pin rod passes through all of the aligned apertures;

a rod head on one end of the pin rod holds the pin rod in place in combination with a rod aperture in pin rod, oppositely disposed from rod head;

the rod aperture receiving a pin rod, thereby holding coupler in position to secure the support bar to either the first vertical bar or the second vertical bar.

* * * * *